US007191708B2

(12) United States Patent
Ouliarin

(10) Patent No.: US 7,191,708 B2
(45) Date of Patent: Mar. 20, 2007

(54) FLASH AND SOUND EMITTING DIVERSION GRENADE

(76) Inventor: Robert Ouliarin, PO Box 1422, Darlinghurst, NSW, 1300 (AU)

( * ) Notice: Subject to any disclaimer, the term of this patent is extended or adjusted under 35 U.S.C. 154(b) by 0 days.

(21) Appl. No.: 10/565,500

(22) PCT Filed: Aug. 5, 2004

(86) PCT No.: PCT/AU2004/001033

§ 371 (c)(1),
(2), (4) Date: Jan. 23, 2006

(87) PCT Pub. No.: WO2005/015118

PCT Pub. Date: Feb. 17, 2005

(65) Prior Publication Data

US 2006/0230972 A1 Oct. 19, 2006

(30) Foreign Application Priority Data

Aug. 6, 2003 (AU) ..... 2003904143
Jan. 9, 2004 (AU) ..... 2004900098

(51) Int. Cl.
*F42B 8/00* (2006.01)

(52) U.S. Cl. ..... 102/502; 102/355; 102/498; 102/513

(58) Field of Classification Search ..... 102/355, 102/498, 502, 513
See application file for complete search history.

(56) References Cited

U.S. PATENT DOCUMENTS 3,596,078 A * 7/1971 Owens ..... 362/184
3,762,330 A * 10/1973 Hall ..... 102/487
5,246,372 A * 9/1993 Campagnuolo et al. ..... 434/11
5,351,623 A * 10/1994 Kissel et al. ..... 102/498
6,065,404 A * 5/2000 Ripingill et al. ..... 102/498

* cited by examiner

*Primary Examiner*—Stephen M. Johnson
(74) *Attorney, Agent, or Firm*—Molins & Co.

(57) ABSTRACT

A diversion grenade (200) comprising: a transparent body (102) in which is located one or more charges of flash material (104); an internal power supply (114); a control circuit (126) that is responsive to one or more inputs, the control circuit (126) producing one or more output signals; and an external user operated trigger (110) for initiating a user input for activating the grenade (200). The grenade (200) may also include tracer lights (122) and sound emitters (201).

14 Claims, 4 Drawing Sheets

FLASH AND SOUND EMITTING DIVERSION GRENADE

FIELD OF THE INVENTION

The invention pertains to grenades and more particularly to a grenade that emits a brilliant flash of light and optional sound, or just sound without rupturing, shattering or creating a risk of subsequent ignition.

BACKGROUND OF THE INVENTION

Common hand grenades are traditionally used at close quarters to create an explosion and dispel fragments. Other types of grenades are also known. A stun grenade creates a combination of explosive shock wave or disruptive concussion, high levels of noise and an accompanying flash that is not contained by the body of the grenade. Known light emitting grenades are used to create a useful level of light of relatively long duration. Known light grenades emit a level of light which is useful for conducting military or police operations in areas where there is insufficient light to operate safely.

However, known distraction type grenades rely on an explosion or pyrotechnic device to create a diversion. Because of the explosive nature of these devices, they constitute a combustion hazard and are not suitable in fuel rich environments, engine rooms, airplanes, enclosed spaces, chemical laboratories, mines and other environments where a combustion initiator cannot be tolerated.

OBJECTS AND SUMMARY OF THE INVENTION

It is an object of the invention to provide a grenade which emits a distraction flash or sound or both but which is not a combustion initiator.

It is also an object of the invention to provide a grenade that does not fragment, rupture or dispel fragments when activated.

It is a further object of the invention to provide a grenade which emits a distraction flash or sound or both, but which grenade is not a combustion initiator.

Accordingly there is provided a grenade comprising a transparent body that contains a flash material. The flash material is activated by an electrical initiating element carried by the body and itself activated by a release mechanism.

In preferred embodiments of the invention, a delay mechanism retards the activation of the flash material for an interval after the release mechanism is triggered.

In some embodiments the delay mechanism is a capacitive device that is supplied a voltage from a battery.

In some other embodiments, the grenade carries a tracer light source which is optionally activated by the user and which emits a second source of light that may commence its emission before the flash material is activated.

A source of sound emissions may be combined with or used in place of any of the above-suggested light emitting embodiments.

BRIEF DESCRIPTION OF THE DRAWING FIGURES

BEST MODE AND OTHER EMBODIMENTS OF THE INVENTION

Figure 1:
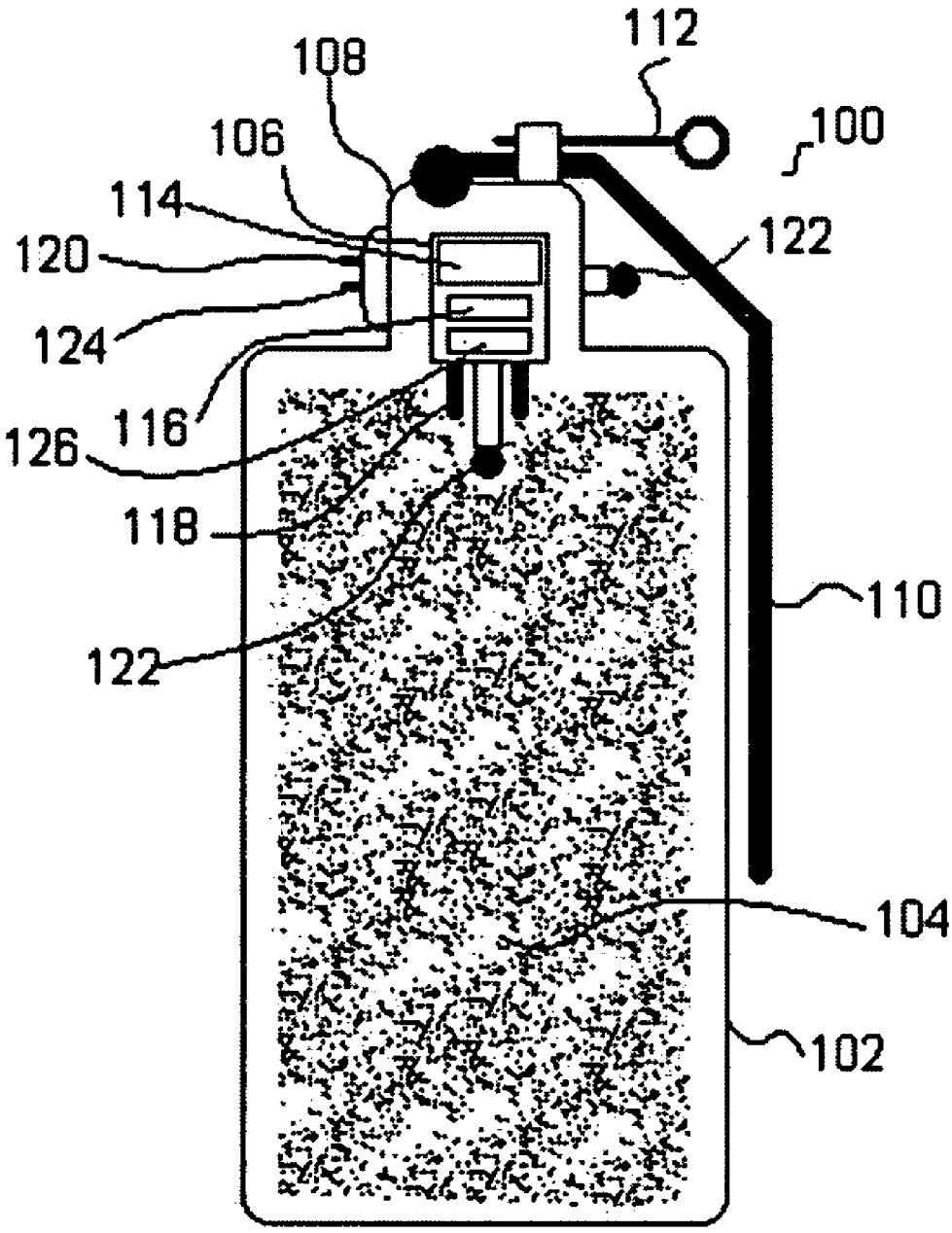
FIG. 1 is an elevation of a flash diversion grenade made in accordance with the teachings of the present invention.

As shown in FIG. 1, a diversion grenade 100 comprises a transparent body 102 that contains one or more independent charges of a flash material 104. The flash material may be strands of magnesium or chemically impregnated fibres or the like which produce a high intensity flash of short duration. Each charge of flash material 104 is activated by an electrical initiating element 106 carried on body, for example within a compartment 108. The initiating element(s) 106 may be triggered by, for example, the release of a spring loaded lever 110 which may be temporarily secured by a safety pin 112.

In some embodiments the initiating element 106 comprises a source of power such as batteries 114 which supply an activation current to the flash material 104, for example through electrodes 118. A delay mechanism 116 prevents the current from reaching the flash material 104 until a variable or pre-established interval of time has passed. If variable, the delay interval can be set from controls 120 external to the body. A capacitive storage device can be used as a delay mechanism.

In optional embodiments, the grenade carries a tracer light 122 that may be selectively activated by the user. The tracer light 122 emits a second source of light of lower intensity, such as may be emitted by an incandescent or LED light. The tracer light serves the purpose of attracting the attention of the personnel for whom the diversion grenade is intended. It attracts their attention to better insure that they are looking at the grenade 100 when the flash material 104 is activated. The tracer light 122 may also provide an indication of the path of the grenade, for the benefit of the grenade's user. The tracer may be activated immediately upon release of the lever 110 or it may be delayed briefly so as to not give away the position of the user or thrower. If the delay of the tracer light 122 is variable or if its operation is optional at the choice of the user, a control circuit 126 within the compartment 108 may be used in conjunction with a switch or control knob 124 external to the body. The control circuit 126 is adapted to take all user inputs and combine them into a sequence of control signals that are required to produce the effect or effects desired by the user. The one or more tracer lights 122 may be located within the transparent body or external to it, or both. The control circuit may also provide pulsed current to the tracer light so as to achieve a strobe effect that is known to attract more attention than an uninterrupted light source.

In preferred embodiments the body is fabricated from a cylindrical transparent or translucent polymer that is thick enough to withstand the energy emitted by the flash material without fragmenting, rupturing, dispel fragments or allowing hot material or gas to escape from the body. In preferred embodiments the activation of the flash material results in little or no noise, particularly when compared to a conventional diversion or distraction grenade.

Figure 2:
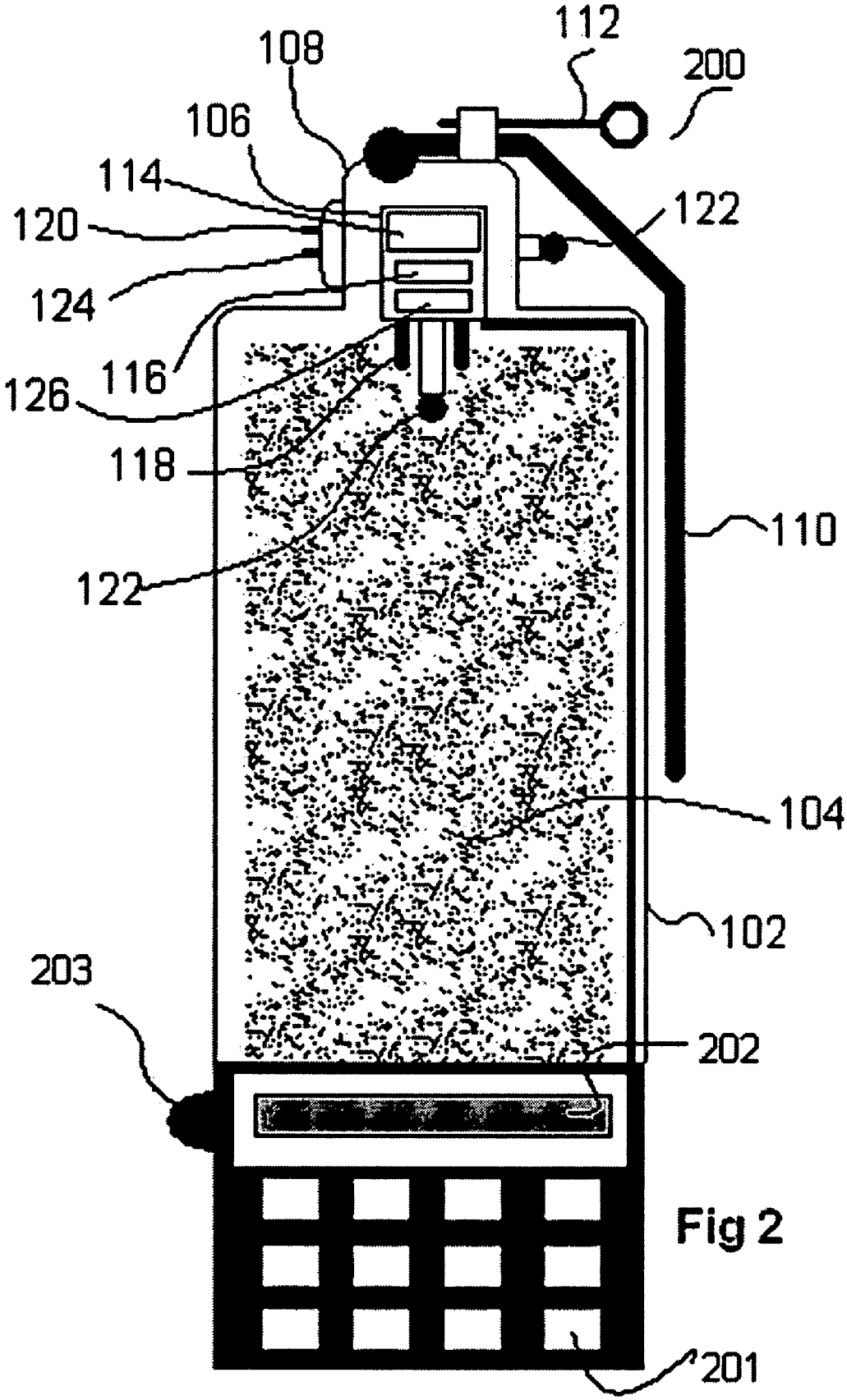
FIG. 2 is an elevation of a flash diversion grenade made in accordance with a second embodiment of the present invention.
Figure 3:
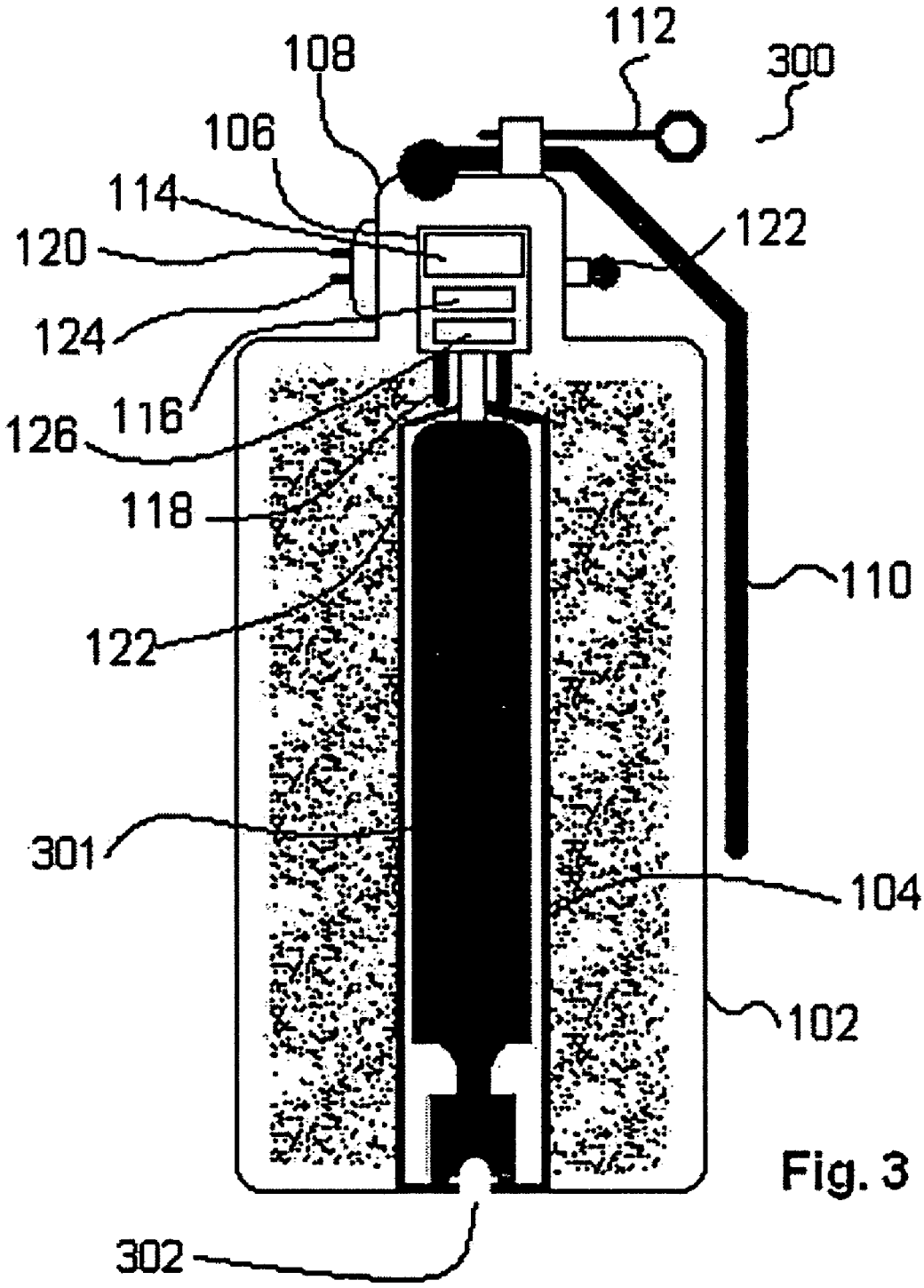
FIG. 3 is an elevation of a flash diversion grenade made in accordance with a third embodiment of the present invention.

In another embodiment, and as shown in FIGS. 2 and 3, the grenade 200, 300 embodies a combination of a brilliant flash and noise. The noise is of a high-pitched noise at a frequency that is disturbing or distracting to the person(s) it was designed to affect. As shown in FIG. 2, the noise (or sound) is emitted via a speaker 201 built within the grenade. The grenade also employs one or more sub-control units comprising optional in-built noise generator circuit, power supply and amplifier (as required) 202 to power the one or more speakers, horns or other sound emitters 201. The sub-controls 202 may be activated in unison or otherwise by the control circuit 126. Where two or more emitters are used, they may be provided at different frequencies, preferably closely spaced frequencies for maximum distraction effect. The noise or sound need last for only several seconds, enough time to provide a debilitating, distracting affect. An external switch 203 gives the ability to select noise or no noise prior to deploying the grenade. When employing both noise and flash, the tracer light 122 is preferably initiated first to attract the attention of the person(s) it was designed to be employed against, and then the flash element and noise initiate to temporarily blind/debilitate/distract the same person(s). The noise or sound then continues to function for several seconds after the flash element has been initiated to continue the distracting effect of the grenade. The sound may be a pre-recorded or synthesized sound, or noise etc.

As shown in FIG. 3, a further embodiment of a combination flash/noise grenade 300 generates noise from the escaping gases of a CO2 (Carbon Dioxide) cartridge or reservoir 301. Under pressure when these gases are released, they pass through a whistle type device 302, producing a distracting, disturbing high frequency noise. The release of these gases occurs simultaneously with the flash element initiation.

The grenade concept of the present invention may be extended to ammunition that can be launched from weapon systems such as handheld 40 mm Grenade launchers. In this embodiment, the grenades incorporate the same characteristics and capabilities as the handheld grenades, but are fired from a weapon. The munition is then preferably impact initiated after a short delay, whereupon the flash element and or the flash element/noise distracting effect occurs.

A larger version of the grenade or device may be used to temporarily blind and distract personnel within the cockpit of an aircraft or rooms within multi-level buildings. The grenade may be supported or located by an adjustable or telescopic pole. It can have small digital cameras attached to provide visual data from which an operator may choose the opportunity to initiate the device at an optimum time. It can have a small illuminator or torch to provide the effect of gaining attention to the persons within building or cockpit. The device may be incorporated into a life size pictures or dummy representing an assaulter.

The grenades of the present invention preferably do not vent flammable gases although they may vent some gases to prevent overpressure rupturing the external case.

In some embodiments the grenades may be initiated by a command issued from a remote wireless RF, IR or other device.

Figure 4:
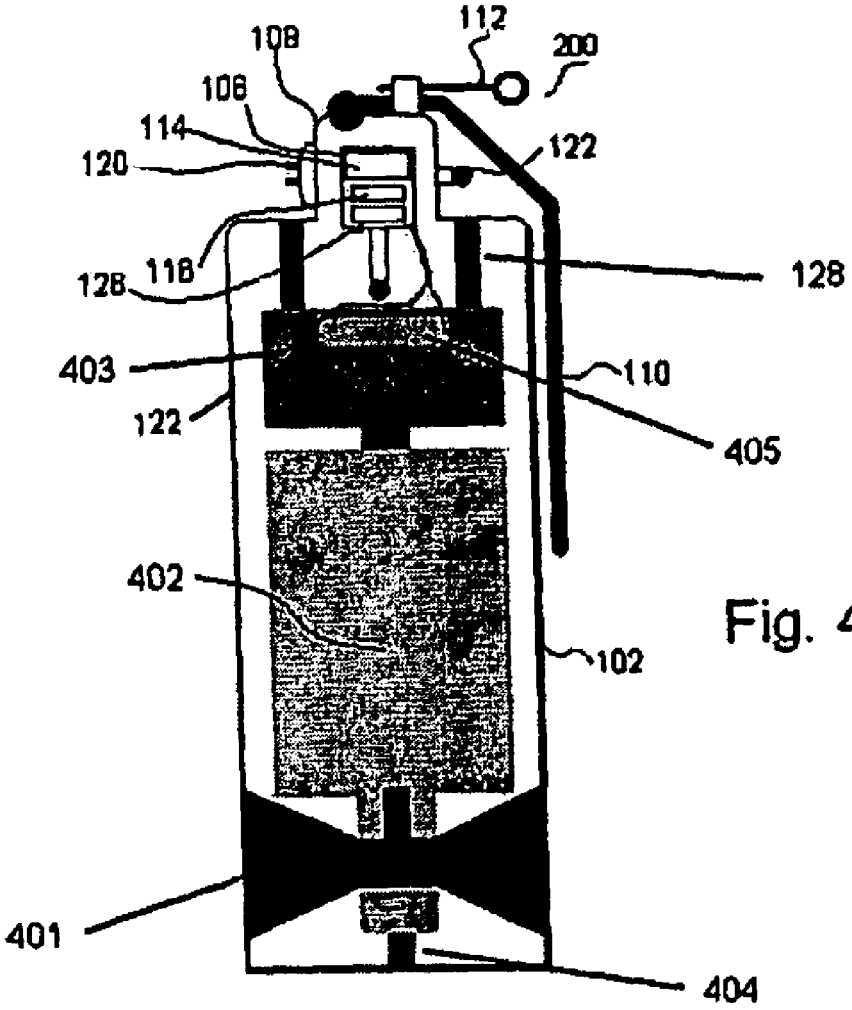
FIG. 4 is an elevation of an aerosol-sonic and flash grenade made in accordance with a further embodiment of the present invention.

As shown in FIG. 4, a sonic grenade may be provided with flash features as well as an aerosol powered sonic emitter. In this example one or more speakers, horns, whistles or other sound emitters 401 are powered by a gas or aerosol cartridge or reservoir 402. The cartridge or reservoir 402 is activated, for example, by a solenoid 403 that drives the cartridge onto an activation pin 404. The solenoid may have its own source of electrical power 405. The power supply 405 is triggered by the control circuits 126 in response to user input. Thus the sonic features of this type of grenade may be controlled separately from the flash features. In this way a the activation or disabling of sound and light or delay of each, or interval between each, or intensity of each can be user controlled with inputs to the control circuit 126. When activated, the contents of the cartridge 402 pass through the emitter(s) 401 to produce a distracting or debilitating sound. Where two or more emitters are used, they may be provided at different frequencies, preferably closely spaced frequencies for maximum distraction effect.

While the invention has been described with reference to particular materials and details of construction, these have been provided as examples and not as limitation to the scope or spirit of the invention.

What is claimed is:

1. A diversion grenade, comprising:

a transparent body in which is located a charge of non-explosive flash material;

an internal power supply;

the body being thick enough to withstand the energy emitted by the flash material without fragmentation or allowing hot material or flammable gas to escape from the body;

a control circuit that is responsive to one or more user inputs, the control circuit producing one or more output signals;

the diversion grenade further comprising an LED tracer adapted to flash before the flash material is activated; and an external user operated trigger for initiating a user input for activating the grenade.

2. The diversion grenade of claim 1, wherein:

a delay mechanism is interposed between the control circuit and the charge.

3. The diversion grenade of claim 1, wherein:

the tracer is located externally of the grenade.

4. The diversion grenade of claim 1, further comprising:

one or more sound emitters that respond to an output signal of the control circuit.

5. The diversion grenade of claim 4, wherein:

each sound emitter has a sub-controller.

6. The diversion grenade of claim 4, wherein:

the emitters are two or more in number.

7. The diversion grenade of claim 4, further comprising:

an external switch for selectively disabling an emitters.

8. The diversion grenade of claim 4, wherein:

the emitter is a speaker and the grenade further comprises a power supply for the speaker and an amplifier.

9. The diversion grenade of claim 4, further wherein:

the emitter is a horn or whistle that is activated by a release of gas or aerosol from within the grenade.

10. The diversion grenade of claim 4, further wherein:

the one or more emitters are used and at least two emitters emit sound at different frequencies.

11. The grenade of claim 4, wherein:

an emitter emits a pre-recorded sound stored within the grenade.

12. The grenade of claim 4, further comprising:

a reservoir of gas or aerosol that is discharged from within the grenade;

the emitter being powered by the discharge of the gas or aerosol.

13. The grenade of claim 1, wherein:

the trigger comprises a spring loaded lever that is retained by a safety pin.

14. The grenade of claim 1, wherein:

the control circuit is responsive to two or more user controls, the user controls providing control over any of the following functions: delay of flash, delay of sound, use of tracer light, delay between flash and sound, sound volume, strobe effect.

* * * * *